US011964213B2

(12) United States Patent
Braun et al.

(10) Patent No.: US 11,964,213 B2
(45) Date of Patent: Apr. 23, 2024

(54) METHOD FOR CONTROLLING A SLIDE DIRECTION IN BRANCH POINT AND BRANCH POINT FOR A SLIDE, IN PARTICULAR A WATER SLIDE

(71) Applicant: Aquarena Holding GmbH, Jettingen (DE)

(72) Inventors: Rainer Braun, Magstadt (DE); Florian Zebisch, Heubach-Lautern (DE)

(73) Assignee: AQUARENA HOLDING GMBH, Jettingen (DE)

( * ) Notice: Subject to any disclaimer, the term of this patent is extended or adjusted under 35 U.S.C. 154(b) by 216 days.

(21) Appl. No.: 17/703,620

(22) Filed: Mar. 24, 2022

(65) Prior Publication Data

US 2022/0305394 A1 Sep. 29, 2022

(30) Foreign Application Priority Data

Mar. 25, 2021 (DE) ..... 102021107560.2

(51) Int. Cl.
*A63G 21/18* (2006.01)
*A63G 31/00* (2006.01)

(52) U.S. Cl.
CPC ..... *A63G 21/18* (2013.01); *A63G 31/007* (2013.01)

(58) Field of Classification Search
None
See application file for complete search history.

(56) References Cited

U.S. PATENT DOCUMENTS 3,556,604 A * 1/1971 Round ..... B65G 51/04 406/10
4,196,900 A * 4/1980 Becker ..... A63G 21/00 472/117
4,578,188 A * 3/1986 Cousino ..... E03F 5/12 210/170.03
5,213,547 A * 5/1993 Lochtefeld ..... E04H 4/0006 472/117
5,322,387 A * 6/1994 Heine ..... E03F 1/002 210/519
6,450,891 B1 * 9/2002 Dubeta ..... A63G 21/18 472/117
6,743,107 B2 * 6/2004 Dubeta ..... A63G 21/18 472/117
6,743,108 B2 * 6/2004 Hunter ..... A63G 21/18 472/117

(Continued)

FOREIGN PATENT DOCUMENTS

DE 69122400 T3 12/2000
DE 202007014719 U1 7/2008

*Primary Examiner* — Joseph A Dillon, Jr.
(74) *Attorney, Agent, or Firm* — KRIEGSMAN & KRIEGSMAN

(57) ABSTRACT

Method for controlling a slide direction in a branch point and a slide, in particular a water slide, in which a slide surface of the branch point is wetted with water, and the branch point is formed: with a first slide connector for a slide entrance, with a second slide connector for a slide exit, with a third slide connector for a further slide exit, wherein the first and second slide connector are provided adjacently to each other, and the third slide connector is provided removed from or opposite the first and second slide connector, and a mouth region is formed between the first and second slide connector and the third slide connector.

19 Claims, 3 Drawing Sheets

(56) References Cited

U.S. PATENT DOCUMENTS

Figure 1:
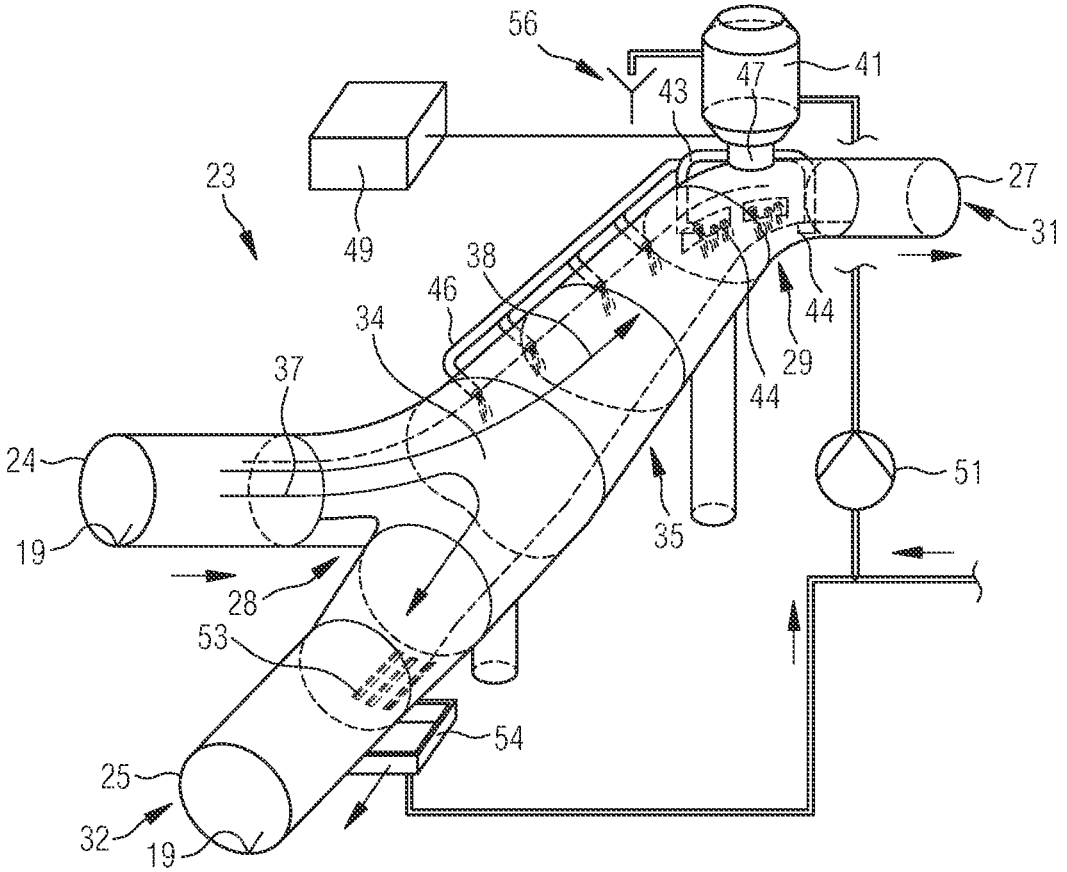

| | | | | |
|---|---|---|---|---|
| 7,854,662 | B2 | 12/2010 | Braun et al. | |
| 8,733,400 | B2 * | 5/2014 | Muggli | B01D 3/008 55/440 |
| 9,533,232 | B2 | 1/2017 | Braun | |
| 11,090,571 | B2 * | 8/2021 | Hunter | A63G 21/18 |
| 2002/0142851 | A1 | 10/2002 | Hunter | |
| 2005/0047869 | A1 | 3/2005 | Lochtefeld | |
| 2005/0075180 | A1 | 4/2005 | Dubeta | |
| 2005/0288112 | A1 * | 12/2005 | Hunter | A63G 21/18 472/117 |
| 2007/0049385 | A1 * | 3/2007 | Henry | A63G 3/00 472/117 |
| 2008/0153610 | A1 * | 6/2008 | Braun | A63G 21/18 472/117 |
| 2011/0177872 | A1 * | 7/2011 | Hunter | A63G 21/18 472/117 |
| 2011/0183768 | A1 * | 7/2011 | Olive | A63G 21/18 472/117 |
| 2012/0190465 | A1 * | 7/2012 | Hunter | A63G 21/18 472/117 |
| 2012/0258812 | A1 | 10/2012 | Osterman et al. | |
| 2013/0184087 | A1 * | 7/2013 | Degirmenci | A63G 21/04 472/117 |
| 2015/0045128 | A1 * | 2/2015 | Fischer | A63G 21/10 472/116 |
| 2015/0045129 | A1 * | 2/2015 | Brassard | A63G 21/18 472/117 |
| 2017/0106295 | A1 * | 4/2017 | Hunter | A63G 21/10 |
| 2018/0036643 | A1 * | 2/2018 | Klarer | A63G 31/007 |
| 2019/0143226 | A1 * | 5/2019 | Briggs | A63G 21/18 472/117 |
| 2020/0215441 | A1 * | 7/2020 | Ozturk | A63G 21/18 |
| 2020/0222818 | A1 * | 7/2020 | Chutter | A63G 21/18 |
| 2022/0305393 | A1 * | 9/2022 | Braun | A63G 21/18 |
| 2023/0113886 | A1 * | 4/2023 | Jenson | A63G 21/10 472/116 |
| 2023/0277949 | A1 * | 9/2023 | Hunter | A63G 21/18 472/117 |

* cited by examiner

METHOD FOR CONTROLLING A SLIDE DIRECTION IN BRANCH POINT AND BRANCH POINT FOR A SLIDE, IN PARTICULAR A WATER SLIDE

The invention relates to a method for controlling a slide direction in a branch point of a slide, in particular a water slide, and a branch point for a slide track of such a slide.

US 2005/0075180 A1 discloses a water slide which, starting from a take-off zone, comprises a run-up section followed by a slide reversal element comprising a first slide connector connected to the run-up section. Following the first slide connector, an uphill section is provided, through which the slide direction is reversed, such that the sliding person is transferred to a second slide connector adjacent to the first slide connector in order to enter a subsequent slide section. This arrangement may be repeated several times until the sliding person enters a run-out section leading into the landing zone, starting from the last slide direction reversal element. At each slide reversal element, there is a change in the slide direction, wherein the sliding person carries out a direction reversal in an undefined manner, such that the sliding person randomly leaves the slide reversal element feet-first or head-first and enters the landing zone.

US 2002/0142851 A discloses a white-water slide track in which one or more persons can experience a slide ride on a tyre. This slide comprises, starting from the take-off zone, a first run-up section which opens into a branch point. The branch point has a second slide connector adjacent to the first slide connector and a third slide connector opposite the first two. This third slide connector is elevated compared to the first and second slide connectors. If the sliding person enters the branch point with a low kinetic energy, they do not reach the elevated third slide connector, but slide in the opposite direction via the second slide connector into a further slide section. If the sliding person has sufficient kinetic energy, they can continue to slide feet first and enter a bonus section via the third slide connector, which leads into a subsequent second branch point. The second slide connector of the preceding branch point also opens into this second branch point. The sliding person can thus continue the slide either feet-first or head-first. In the run-out section, the sliding person enters the landing zone either head-first or feet-first, depending on the particular kinematic energy.

With the slide track of the slide according to US 2002/0142851 A, the slide path through the branch point depends on the kinetic energy of the sliding person.

The object of the present invention is to propose a method for controlling a slide direction in a branch point and a branch point for a slide track of a slide, in particular a water slide, as a result of which controlling a slide path out of the branch point is possible.

This object is solved by a method for controlling a slide direction in a branch point for a slide track, in particular a water slide, in which a through slide or a direction reversal in the branch point is controlled via at least one controllable water nozzle, by means of which an amount of water is supplied to an upstream section and/or a peak provided to the upstream section and a third slide connector. The branch point comprises a first slide connector for a slide entry and a second slide connector for a slide exit as well as a third slide connector for a further slide exit. The first and second slide connectors are provided adjacently to each other, and the third slide connector lies opposite the first and second slide connector. A mouth region is formed between the first and slide connector and the third slide connector. A first slide path in the branch point extends from a first slide connector to the second slide connector, which are adjacent to each other, such that a reversal in the sliding direction of the sliding person occurs. A second slide path extends between the first and the third slide connector, such that there is a through slide in the same sliding direction. The first, second and third slide connectors have a common mouth region in the branch point. Starting from this mouth region, an upstream section follows in the direction of the third slide connector. A peak can be formed between the upstream section and the third slide connector. The further slide track can be controlled for the person who will be sliding by means of this branch point. For example, a so-called bonus section can be attached to the third slide section and a so-called short section to the second slide connector. Depending on the amount of water supplied to the peak and/or upstream section, it can be influenced as to whether the sliding person reaches the bonus section or is transferred to the short section. With a greater amount of water which is introduced into the region of the peak and/or the upstream section, a resistance is increased when sliding forwards along the upstream section by the amount of water flowing down in the upstream section, such that a through slide into the bonus section is prevented. If only a small amount of water is supplied into the upstream section and/or onto the peak or only a wetting of the sliding surface is carried out, the resistance by the water flowing down can be considerably reduced, whereby a through slide of the second slide path through the branch point is possible.

It is preferably provided that water is supplied in the crest of the peak via the at least one controllable water nozzle of the slide surface. This has the advantage that, on one hand, a control of the slide resistance in the upstream section can be controlled and, on the other hand, the subsequent bonus section can be supplied with water in order to reduce the frictional losses.

Furthermore, it is preferably provided that a storage container is positioned above the peak of the branch point, which is filled with water by a pump, wherein at least one water nozzle of the branch point is fed with water from the storage container. This has the advantage that a low technical effort is necessary, since the water enters the branch point from the storage container via the at least one water nozzle by means of gravity.

It is preferably provided that the water container is filled with a constantly driven conveying pump. This has the advantage that the attrition of the conveying pump is low. Advantageously, the pump has a small conveying power. Thus, a cost-effective design can be made possible. In particular, as a result of the constant conveying power, a sufficient filling of a storage container can be made possible.

Furthermore, it can be provided that the supply container is filled by excess water from a slide section and is conveyed into the storage container by the conveying pump. For example, at the second slide connector, which is the deepest, when seen in the vertical direction, in relation to the further slide connectors, excessive water can be discharged into a collecting container below it. This collected water can be conveyed back again into the storage container via the conveying pump. Thus, a closed circuit can be formed inside the branch point for a predetermined amount of water.

Alternatively, it can be provided that the storage container positioned above the peak of the branch point is filled with excess water from a slide section running above the storage container. For example, a slide portion, in particular with a well, can be provided above the storage container, and the water collected in it can be discharged via mouth openings or other drainage openings and supplied to the storage container. Thus, a reduction of the water consumption can be obtained.

It is advantageously provided that the storage container is opened to output the stored water with an electrically controllable closure via a control signal. Thus, a temporally defined supply of an amount of water into the branch point can be made possible.

The closure preferably has a large opening cross-section, such that a torrential supply of water can be controlled.

According to a further preferred design of the method for controlling the branch point, it is provided that the control signal is provided for opening the electrically controllable closure by a light barrier in the branch point or in the slide section leading to the branch point. Thus, the sliding person themselves causes the supply of the amount of water into the branch point. Alternatively, it can be provided that the user themselves selects a control signal in the start zone of the slide as to whether or not an amount of water is supplied to the branch point in the region of the peak and/or the incline section. A further alternative embodiment of the method provides that a triggering button is provided adjacently to the slide, such that the supply of the amount of water is controlled by a third person by pressing the trigger button. Furthermore, it can alternatively be provided that the supply of water is triggered in temporal intervals by a control device in a time-controlled manner or at random. Thus, there is a variant variety for controlling the slide device in the branch point, which can be influenced in part by the sliding person themselves, yet can be controlled surprisingly and independently of the sliding person.

The object underlying the invention is furthermore solved by a branch point for a sliding track of a slide, in particular a water slide, in which water can be supplied via at least one controllable water nozzle of an incline section in the branch point and/or a peak in the branch point. A first or second slide path can be carried out by this at least one controllable water nozzle. The sliding person can either slide through the incline section and reach the peak along the second slide path in order to then slide into a further slide section, in particular a bonus slide section—i.e. an additional slide section—by maintaining the sliding direction, i.e. feet-first, or to slide in the opposite sliding direction, i.e. head-first, along the first sliding path, in particular to the short section. The first or the second sliding path of the branch point can thus be controllable by the amount of water that can be supplied. Here, the control can be carried out in such a way that the sliding person does not know at the point in time of entering the slide which slide path they can travel along. Alternatively, it can also be provided that it is possible to preset the branch point by the sliding person in the starting zone, by the person selecting whether an amount of water is supplied to the branch point in order to slide through the first sliding path or as to whether the supply of the amount of water stops in order to slide through the second slide path.

It is preferably provided that the at least one controllable water nozzle is arranged laterally to the sliding surface and/or above the sliding surface. Depending on the amount to be supplied, a plurality of water nozzles can be provided with small cross-sectional openings or also a smaller number of water nozzles with larger cross-sections, in particular for flooding the sliding surface.

According to a preferred design of the branch point, it is provided that a storage container for water is provided above the peak of the branch point, preferably close to the third slide connector. Thus, a great water volume can be temporarily provided in order to supply this to the peak and/or the incline section.

Advantageously, the storage container can be filled with a conveying pump, in particular a constantly functioning conveying pump with a low conveying output. Thus, the complexity of the equipment is minimal.

Alternatively, it can be provided that a slide section runs above the slide container and excessive water from the slide section can be transferred into the storage container. This arrangement can also make it possible for there to be no need for the conveying pump for filling the storage container. Alternatively, by additionally using the conveying pump, it can be possible to fill the storage container more quickly in order to enable shorter cycles when controlling the branch point.

The storage container advantageously has an electrically controllable closure, which can be controlled by a control signal for opening and closing. Thus, there are various possibilities and/or applications in order to control the point in time for outputting the stored water from the storage container into the branch point.

Preferably, a light barrier can be provided in the sliding route, in particular the branch point, which recognises the sliding person sliding through and triggers the control signal to open the closure. Alternatively, it can be provided that the user themselves, for example in the start zone, sets the control signal as to whether or not the closure is to be opened in order to thus control the first or second sliding path. Alternatively, the control signal can also be emitted by a trigger button via a third person or in a computer-controlled manner.

Figure 2:
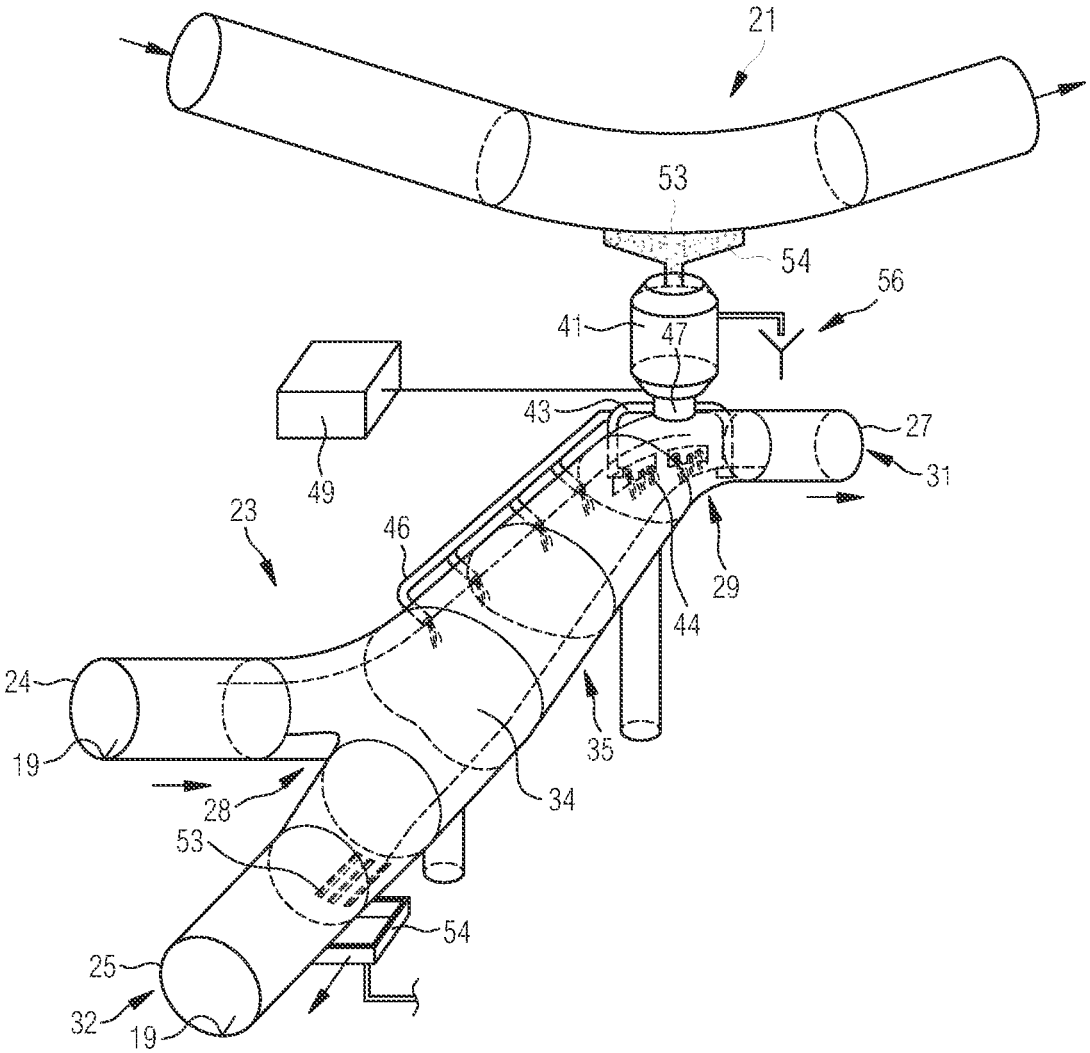
Figure 3:
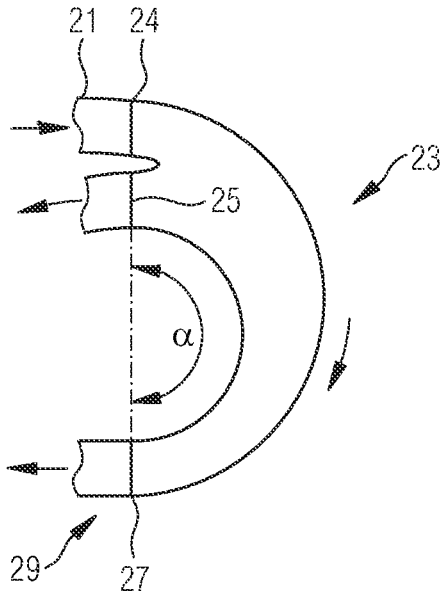
Figure 4:
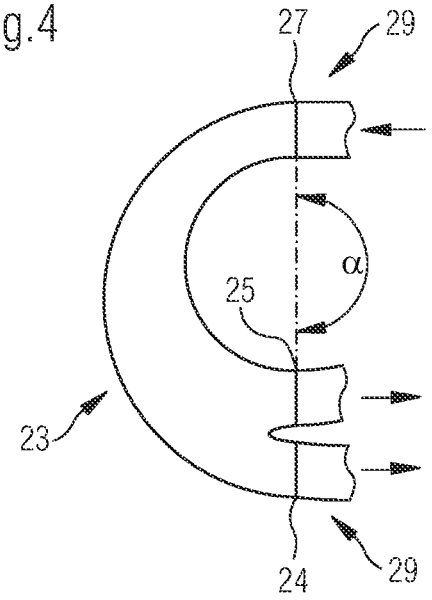

The invention and further advantageous embodiments and developments thereof are described and explained in more detail below by means of the examples depicted in the drawings. The features that can be seen in the description and the drawings can be applied individually or collectively in any combination according to the invention. Here are shown:

FIG. 1 a perspective view of a branch point for a slide,

FIG. 2 an alternative embodiment of the slide to FIG. 1,

FIG. 3 a schematic view from above of an alternative embodiment of the branch point, and FIG. 4 a schematic view from above of the branch point according to FIG. 3 with an alternative connection into a slide section.

A branch point 23 for a slide not depicted in more detail is depicted in FIG. 1. With such a slide, a slide surface can be wetted with water, a water film or spray mist, such that the sliding person glides directly on the slide surface. Such a slide can also be a tyre slide in which one or more person slides on a tyre.

The branch point 23 can be integrated into a slide track between a start zone and a landing zone, in order to divide the slide track into various slide sections.

The branch point 23 comprises a first slide connector 24 and a second slide connector 25 adjacent to it. A third slide connector 27 is provided opposite the first and second slide connector or removed from them. In this embodiment of the branch point 23, it is provided that the first slide connector 24 lies above the second slide connector 25 when seen in the vertical direction, and the third slide connector 23 is positioned above the first slide connector 24. The slide connectors 24, 25 and, removed from them or opposite them, the third slide connector 27 form a Y-shaped contour of the branch point 23.

The first and second slide connector 24, 25 are separated by a bead-shaped elevation 28 which decreases in a mouth region 34 between the first, second and third slide connector 24, 25, 27 and transitions into the slide surface 19. An incline section 35 extends starting from a mouth region 34 up to the third slide section 27. A peak 29 can be provided between the incline section 35 and the third slide connector 27. The third slide connector 27 can also in turn be provided to be indented in comparison to a crest of the peak 29. This third slide connector 27 is, however, still positioned above the first slide connector 24.

The branch point 23 depicted in FIG. 1 can be incorporated into a slide track as follows: the first slide connector 24 can form a slide entrance. The second slide connector 25 and the third slide connector 27 then respectively form a slide exit. If the sliding person who enters the branch point 23 via the first slide connector 24 slides along the second slide path 38, which preferably extends virtually in a straight line or in a straight line, to the third slide connector 27 and can then reach a bonus section 31—i.e. an additionally extended slide section of the slide track. If the kinetic energy has been reduced by the sliding person or is not sufficient, the sliding person can reach the branch point 23 via the first slide connector 24 and cannot surmount the incline section 35 and/or the peak 29 and slides in the opposite direction along the first slide path 37 though the second slide connector 25 out of the branch point 23 and reaches a short section 32, for example.

The branch point 23 now enables an active control as to whether or not the sliding person slides through along the second slide path 38.

For example, it can be provided that the incline section 35 up to the peak 29 is designed in such a way that each sliding person who is allowed to slide brings a sufficient amount of kinetic energy when entering the branch point 23 via the first slide connector 24 in order to reach the third slide connector 27. By supplying the amount of water onto the peak 29 and/or into the incline section 35 in a specific, controlled and/or random manner, it can be obtained that a resistance when sliding uphill on the incline section 35 is constructed by the added amount of water, such that the sliding person cannot surmount the incline section 35 and leaves the branch point 23 by means of the second sliding section 25.

In order to control the branch point 23, the storage container 41 for storing water is preferably provided above the incline section 35 or above the peak 29 of the branch point 23. This storage container 41 is connected to one or more water nozzles 45 by means of one of more lines 43, which water nozzles transfer an amount of water to the sliding surface 19. In the region of the peak 29 and/or in a transition region between the incline section 35 and the peak 29 and/or in the incline section 35, at least one water nozzle 44 can be provided. Advantageously, water nozzles 44 are provided opposite one another on a laterally increased wall section in relation to the slide surface 19. With a completely closed channel 46, which comprises the slide surface 19 and closes this, at least one water nozzle 44 can additionally or alternatively be provided on an upper side of the channel 46—i.e. opposite the sliding surface 19. Several water nozzles 44 can also be provided on a radial plane in the channel for forming a water curtain.

The storage container 41 preferably comprises a water volume, which corresponds to a multiple, which is necessary for wetting the slide surface 19 in the incline section 35. Preferably, an amount of water of at least 101 is provided. The storage container 41 comprises a closure 47, which preferably has a large opening cross-section, such that a large amount of water can be removed from the storage container 41 in a short amount of time and can be supplied to the slide surface 19 via the at least one water nozzle 44, preferably in the manner of a torrent. This closure 47 can be controlled to open and close via a control signal.

Triggering a control signal to open the closure 27 on the storage container 41 can be controlled by a control device 49 at regular intervals or controlled in a random manner and at intervals that are temporally predetermined to be the same or different to one another. Alternatively, it can be provided that the control device 49 is controlled by a triggering head, which can be triggered by a third person. The control device 49 can also be controlled by a selection switch or setting button in the start zone, such that the slider themselves can set whether or not an amount of water is introduced into the incline section 35 upon reaching the branch point 23.

The control signal can also be emitted by a light barrier in the slide track 16, which is connected to the control device 49.

A conveying pump 51 is preferably provided for filling the storage container 41. This conveying pump 51 is advantageously driven by a continuous conveying power. Here, the conveying volume is low. Due to the successive sliding at time intervals, there is sufficient time to fill the storage container 41. Advantageously, it can be provided that excessive water is deflected via slots 53 or through openings into a capturing container 54, for example at the second slide connector 25, and the conveying pump 51 conveys the water from the capturing container 54 into the storage container 41. In this way, the consumption of fresh water can be reduced.

If a control signal for dispensing the amount of water out of the supply container 41 were not to take place for a long amount of time, the storage container 41 has an overflow 56 which preferably ends in the capturing container 54, in order to dispense the excessive water again, for example by the conveying pump 51 and to supply it to the storage container 41.

In FIG. 2, an alternative embodiment of the branch point 23 to FIG. 1 is depicted. The construction of the branch point 23 and the arrangement of the storage container 41 and the supply of the water via the at least one water nozzle 44 corresponds to the embodiment according to FIG. 1. Conversely in this embodiment, it is provided that the storage container 41 is not filled by a conveying pump 51, but by a slide section 21 running above the storage container 51. Water can also be guided in this slide section 21 for minimising friction along the sliding surface 19. In a section of the slide section 21, in particular in a hollow, slots 53 can be provided, through which the excessive water is guided out of the slide section 21 and is supplied to the storage container 41. For example, a collecting container 54 can in turn be provided below the slide section 21 which is connected to the storage container 41 via a line. When positioning the slide section 21 above the storage container 41, the supply can be carried out without a conveying pump 51 only due to gravity. The conveying pump 51 can also be attached to support this.

In FIG. 3, a schematic view of an alternative embodiment of the branch point 23 is depicted. In this embodiment, it is provided that a curved or arcuate or elliptical course is provided between the adjacent first and second slide connectors 24, 25 and the third slide connector 27 opposite or arranged removed from it. The first and second slide section 24, 25 are arranged adjacently to each other. The third slide section 27 is positioned at an angle $\alpha$ in relation to the first and second slide connector 24, 25. This angle $\alpha$ can be 180° according to the depiction in FIG. 3. This angle α can fundamentally comprise a range of from 45 to 270°.

In this embodiment, it is provided that the sliding person slides into the branch point 23 through a supplying slide section 21, which leads to the first slide connector 24. In the region of the third slide connector 27 or in the third slide connector 27, a peak 29 or elevation is provided downstream, i.e. the third slide connector 27 or a peak 29 provided shortly before or after it or elevation is elevated at the first slide connector 24 in relation to the entrance to the branch point 23. Thus, with insufficient kinetic energy, the sliding route via the dispensing slide section, which is attached to the third slide connector 27, cannot take place. The sliding person thus slides from a region in or near the third slide connector 27 back again into a further dispensing slide section 21, which is attached to the second slide connector 25.

In FIG. 4, the branch point 23 according to FIG. 3 is depicted, wherein an alternative connection into a slide section of a slide 11 is depicted. In this embodiment, it is provided that the sliding person slides into the branch point 23, 30 via the third slide connector 27. If there is a high degree of kinetic energy, the sliding person can leave the branch point 23 via the first slide connector 24. With less kinetic energy, the sliding person will leave the branch point 23 via the second slide connector 25. This is caused by the first slide connector 24 being elevated in comparison to the second slide connector 25.

The branch point 23 can be formed from closed tubes. These closed tubes can be formed from plastic. These tubes can be formed from opaque materials. Partially, sectionally or completely transparent portions of the tubes can also be provided.

REFERENCE NUMBERS

16. Slide track
19. Slide surface
21. Slide section
23. Branch point
24. First slide connector
25. Second slide connector
27. Third slide connector
28. Bead-shaped elevation
29. Peak
31. Bonus section
32. Short section
34. Mouth region
35. Incline section
37. First slide path
38. Second slide path
41. Storage container
43. Lines
44. Water nozzle
46. Channel
47. Closure
49. Control device
51. Conveying pump
53. Slot
54. Collecting container
56. Overflow

The invention claimed is:

1. Method for controlling a slide direction in a branch point of a slide, in which a slide surface of the branch point is wetted with water, and the branch point is formed:

with a first slide connector for a slide entrance, with a second slide connector for a slide exit, with a third slide connector for a further slide exit, wherein the first and second slide connector are provided adjacently to each other, and the third slide connector is provided removed from or opposite the first and second slide connector, and a mouth region is formed between the first and second slide connector and the third slide connector, with a first slide path, which runs from the first slide connector to the second slide connector, and with a second slide path, which runs from the first slide connector to the third slide connector, wherein the third slide connector is elevated in relation to the first and second slide connector when seen in the vertical direction and, starting from the mouth region, an incline section is provided in the direction of the third slide connector, wherein water is supplied to the incline section and/or a peak provided between the incline section and the third slide connector via at least one controllable water nozzle, and a through slide of the first or second slide path is controlled by the amount of water supplied to the slide surface in the incline section and/or the peak.

2. Method according to claim 1, wherein the at least one water nozzle is provided along the incline section and/or at least one crest of the peak, and water is supplied to the slide surface.

3. Method according to claim 1, wherein a storage container is positioned above the peak of the branch point, and the at least one water nozzle of the branch point is fed with water out of the storage container.

4. Method according to claim 3, wherein the storage container is filled by a conveying pump).

5. Method according to claim 3, wherein the conveying pump is a continuously running conveying pump, which has a low conveying power.

6. Method according to claim 3, wherein the storage container is filled by excess water from a slide section and is conveyed by the conveying pump into the storage container.

7. Method according to claim 3, wherein the storage container is filled by excess water from a slide section, which runs above the storage container and is dispensed from the slide section running above.

8. Method according to claim 3, wherein the storage container is opened to dispense the stored water with an electrically controllable closure via a control signal.

9. Method according to claim 8, wherein a torrent-like water supply is controlled by the closure.

10. Method according to claim 8, wherein the control signal for opening the closure is triggered by a light barrier in the branch point or in the slide track or by a user in a start zone of the slide or by a triggering button by a third person adjacent to the slide or by a control device of the slide in temporal gaps in a time controlled manner or at random.

11. Method according to claim 1, wherein a slide direction in a branch point of a waterslide is controlled.

12. Branch point for a slide track of a slide for controlling a slide direction in the branch point of the slide, in which a slide surface of the branch point is wetted with water, and the branch point is formed:

with a first slide connector for a slide entrance, with a second slide connector for a slide exit, with a third slide connector for a further slide exit, wherein the first and second slide connector are provided adjacently to each other, and the third slide connector is provided removed from or opposite the first and second slide connector, and a mouth region is formed between the first and second slide connector and the third slide connector, with a first slide path, which runs from the first slide connector to the second slide connector, with a second slide path, which runs from the first slide connector to the third slide connector, wherein the third slide connector is elevated in relation to the first and second slide connector when seen in the vertical direction and, starting from the mouth region, an incline section is provided in the direction of the third slide connector, wherein at least one water nozzle is provided in the incline section and/or in a peak formed between the incline section and the third slide connector, by which an amount of water is supply-able in a controlled manner to the incline section and/or the peak.

13. Branch point according to claim 12, wherein a storage container for water is provided above the peak, which is connected to the at least one water nozzle via at least one line.

14. Branch point according to claim 13, wherein at least one, preferably continuously functioning, conveying pump is provided by which the storage container is filled.

15. Branch point according to claim 13, wherein the storage container comprises an overflow, with outlet openings or slots in the slide surface which are allocated to the branch point or a further slide section of the slide.

16. Branch point according to claim 15, wherein the overflow ends in a collecting container.

17. Branch point according to claim 12, wherein a control device is provided, by means of which a control signal is controllable for opening a closure of the storage container.

18. Branch point according to claim 12, wherein the slide surface is formed in a closed channel, and the at least one water nozzle is provided on lateral wall sections of the channel and/or on a radial plane to the slide surface.

19. Branch point according to claim 12, wherein the branch point is for a waterslide.

* * * * *